US005842539A

United States Patent [19]

Hough

[11] Patent Number: 5,842,539

[45] Date of Patent: Dec. 1, 1998

[54] FIRE ESCAPE ASSEMBLY

[76] Inventor: Marion S. Hough, HC 2, Box 67-1, Port St. Joe, Fla. 32456

[21] Appl. No.: 674,974

[22] Filed: Jul. 3, 1996

Related U.S. Application Data

[63] Continuation of Ser. No. 241,503, May 12, 1994, abandoned.

[51] Int. Cl.[6] ..... E06C 9/14

[52] U.S. Cl. ..... 182/70; 182/196

[58] Field of Search ..... 182/70, 74, 196

[56] References Cited

U.S. PATENT DOCUMENTS

| | | | |
|---|---|---|---|
| 192,364 | 6/1877 | Duncan | 182/70 X |
| 197,059 | 11/1877 | Stevenson | 182/70 X |
| 279,186 | 6/1883 | Ricker | 182/70 |
| 285,806 | 10/1883 | Foster | 182/70 X |
| 335,372 | 2/1886 | Marcus et al. | 180/70 |
| 672,206 | 4/1901 | Dodd | 182/70 X |
| 1,647,684 | 11/1927 | Canizaro | 187/70 |
| 2,317,459 | 4/1943 | Hillenbrand | 182/70 X |
| 2,990,908 | 7/1961 | Wozniak | 182/70 |
| 3,677,366 | 7/1972 | Loeffel | 182/70 |
| 3,809,181 | 5/1974 | Staranick et al. | 182/70 |
| 5,020,633 | 6/1991 | Rangel | 182/70 |

FOREIGN PATENT DOCUMENTS

| | | | |
|---|---|---|---|
| 1188021 | 4/1970 | United Kingdom | 182/70 |

*Primary Examiner*—Alvin Chin-Shue
*Attorney, Agent, or Firm*—Arthur G. Yeager

[57] ABSTRACT

A fire escape system includes a ladder permanently attached with cleats to an interior surface of a box that functions both for storage of the ladder and for anchorage of the ladder when in use. The box has a rear side to be placed against a building wall and optionally secured thereto at a position below a window sill and a top ledge mounted on the rear wall. Cleats are mounted to the rear wall are disposed rearwardly of a front edge of the ledge to provide for force applied during use of the ladder to aid in forcing the box against a building wall to inhibit movement of the box during use of the ladder. The ladders used in the system may be constructed of chains with metal rungs.

13 Claims, 4 Drawing Sheets

FIRE ESCAPE ASSEMBLY

This application is a continuation of application Ser. No. 08/241,503 filed on May 12, 1994, now abandoned.

BACKGROUND OF THE INVENTION

1. Field of the Invention

The present invention relates to fire escape ladders and associated storage and anchorage apparatus used therewith.

2. Prior Art

A wide variety of fire escape ladders exist but they are either permanent fixtures such as the external fire escapes used on many buildings or are portable devices with loops or hooks at one end which are used for temporary connection over a window sill. What is needed is a collapsible ladder easily stored out of the way, but one that is permanently affixed to an anchorage device that provides for safe use in an emergency and for use by children who may not have the presence of mind to secure a portable ladder properly before attempting to use it.

SUMMARY OF THE INVENTION

In one aspect of the present invention there is provided a fire escape assembly adapted to be used by a person exiting through a window comprising a collapsible ladder and a movable anchorage means, securing means for affixing the ladder to the anchorage means, the anchorage means including an elongate box defining an interior space for receiving the ladder thereinto during storage thereof and ladder securing means affixed to an interior portion of the box.

In other aspects of the present invention there is provided that the box includes a rear wall to be disposed against a building wall beneath a window sill, the ladder securing means including a pair of spaced apart anchor means attached to the rear wall inwardly of the box, each anchor means being attached to one side of the ladder. The box includes an elongate top member mounted to the rear wall along the length thereof, the top member defining a ledge extending forwardly of the rear wall and forwardly of the anchor means. The anchor means are cleats to which the ladder is attached. The ladder securing means includes a planar plate member mounted to the rear wall, each anchor means including a cleat formed in and extending outwardly from the plane of the plate. The ladder is substantially fireproof and includes a plurality of metal rungs and a pair of lengths of metal chain attached to respective ends of the rungs, and metal securing means for attaching the chains to each of the rungs. The rungs have a hollow box cross-section, the metal securing means including an elongate threaded bolt and nut, the rungs having vertical openings adjacent each end portion, the bolt passing through the openings and through a link of the metal chain disposed between the openings, the nut being threaded on the bolt outwardly of the rung to tightly affix the bolt and nut to the rung.

The anchor means includes a pair of spaced cleats, securing means attached to respective cleats for securing the ladder to the anchor means. The securing means is used for securing the box to a wall beneath a window in a building The elongate box has a planar rear wall to be disposed adjacent a room wall of a building beneath a window sill therein, a pair of planar side walls, a planar front wall, a floor member and a planar ledge member having a front edge and a rearward edge lengthwise thereon, the ledge member being mounted on a top edge of the rear wall to dispose the front edge forwardly of the rear wall, the cleat means being mounted to the rear wall inwardly of the box and rearwardly of the front edge of the ledge member. The cleat means includes a pair of spaced cleats that are disposed downwardly, the second securing means including a loop member secured around each cleat and a cross member having loop portions to and between the cleats to support the side members from respective cleats via the cross member. The cleats means includes an elongate metal plate mounted to and against the rear wall, the plate having a pair of generally oval openings cut out therefrom to define a pair of spaced downwardly disposed T-shaped cleat extending outwardly from the plate or alternately, a pair of generally circular ring-shaped cleat body having an interior space, a downwardly disposed cleat integral to the body and extending into the interior space and outwardly of the body, and a plurality of holes formed in the body for attachment thereof to the rear wall. The cleat means are secured to the rear wall at a lower portion thereof generally adjacent the floor member.

DETAILED DESCRIPTION OF THE PREFERRED EMBODIMENT

Figure 1:
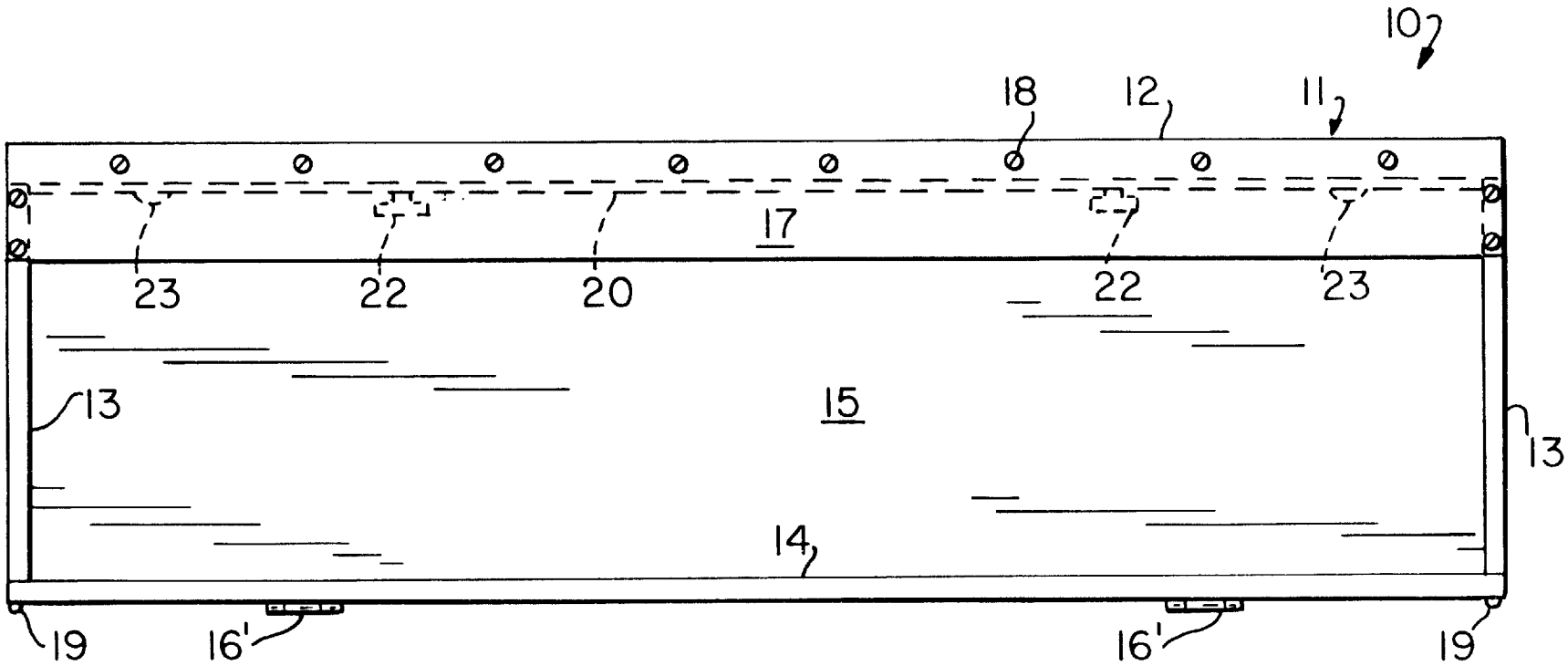
FIG. 1 is a top view of the storage box and anchorage system in accord with the present invention with hinged top member removed.
Figure 2:
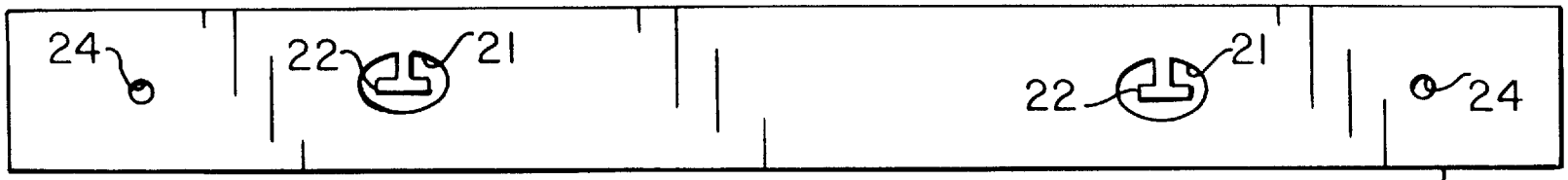
FIG. 2 is a side elevation view of one embodiment of the anchorage means used in the present invention.

With reference now to the drawings, the storage container and anchorage assembly in accord with the present invention is shown generally at numeral 10. The storage box 11 is made of wood and includes a rear wall 12, side walls 13, front wall 14 and floor 15. A top member or lid 16 is attached to front wall 14 with hinge 16'. A ledge member 17 is secured to rear wall 12 via a plurality of screws 18. The rear wall 12 is preferably at least 1" thick to accomodate the ledge member 17 and the anchorage means as will be discussed.

Mounted laterally across rear wall 12 is a thick metal plate 20 having bolt openings 24. Spaced oval openings 21 are formed by cutting a section out of the plate to form downwardly directed cleats 22. Bolts 23 are used to mount the plate 20 to rear wall 12. As shown more clearly in FIG. 3, cleats 22 extend laterally forward.

Box 11 is optionally secured to the studs (not shown) in a building wall 26 via long screws 25. The box 11 is positioned beneath a window sill 28 and fits flush against wall 26 and floor 27. As will be discussed therein below in greater detail, a ladder will be connected to cleats 22 and deployed out of a window over sill 28. Line 30 represents the shape of the ladder when hanging out of the window and under load. Front edge 29 of ledge member 17 is located slightly forwardly of cleats 22 to provide that force applied to the ladder along line 30 will be directed substantally horizontally against wall 26. Ledge 17 is also usuable as a step when the assembly is being used.

Figure 3:
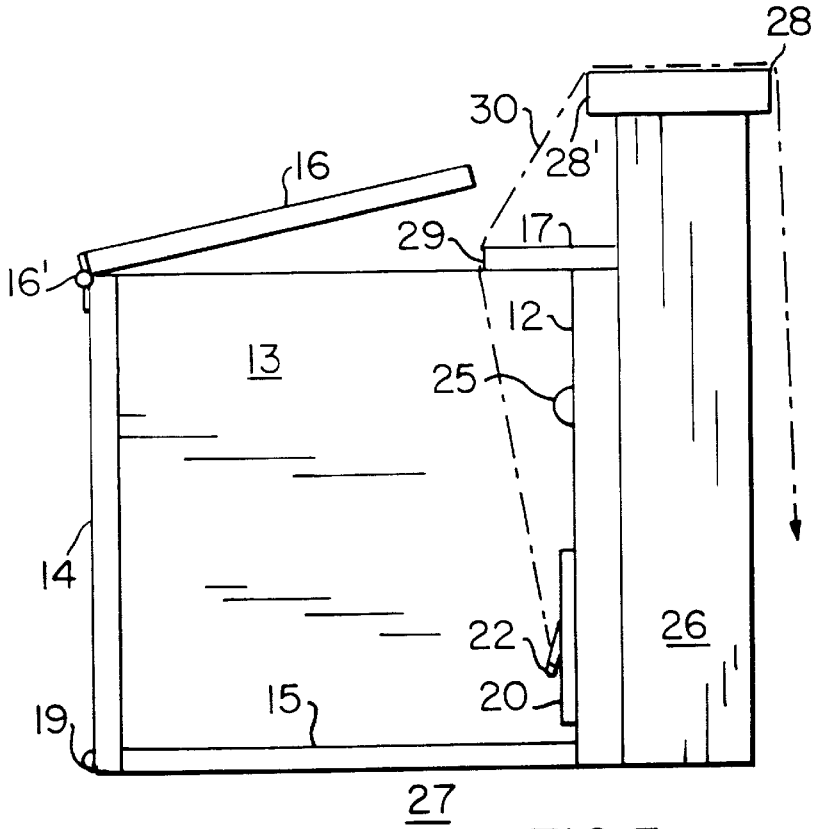
FIG. 3 is a side elevation view of the box of FIG. 1 with a side wall removed to illustrate the internal anchorage assembly.
Figure 4:
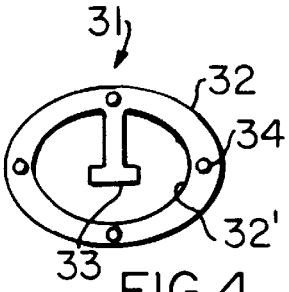
FIG. 4 is an alternative cleat member for use in the present invention.

FIG. 4 illustrates an alternative cleat assembly 31, an oval-shaped body 32, defines opening 32' and includes a downwardly disposed cleat 33 and four screw holes 34. A pair of spaced assemblies 31 can be mounted to box rear wall 12 in plate of plate 20. As clearly shown in FIG. 3, the cleats 22 are mounted closely adjacent the floor 15 of box 11 to facilitate the proper force loading along line 30.

Figure 5:
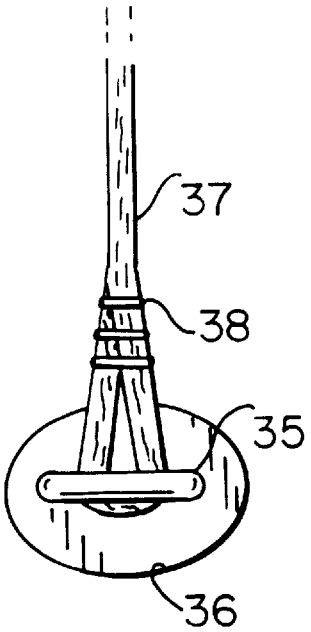
FIG. 5 is a pictorial view of one method of securing a ladder to a cleat.
Figure 6:
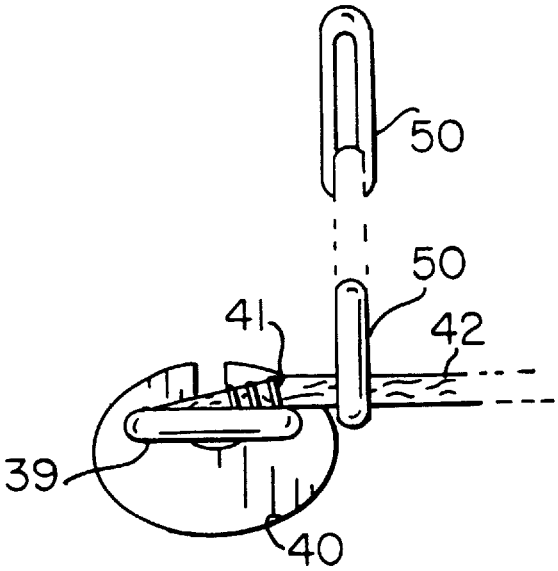
FIG. 6 is a pictorial view of another method of connecting a chain ladder to a cleat.

FIGS. 5 and 6 illustrate two alternate methods of connecting the ladder used in the present invention to the cleats. In FIG. 5, cleat 35 represents either cleat 22 or 33 into an opening 36 (21 or 32'). A non-flammable rope or wire rope/cable member 37 is looped around cleat 35 and counter woven/spliced into itself as understood in the art. Bands 38 further secure the loop into place and provide that the ladder member 37 is permanently attached to the cleat. FIG. 6 illustrates a cleat 39 (22or 33) with opening 40 (21 or 32'). with a cable member 42 connected around each cleat. Securing band 41 keeps cable 42 secured to cleat 39.

The present invention contemplates a ladder for use from a second or third story window in a home. Accordingly, the total weight of the ladder itself is of no real concern. The anchorage may vary however, in other applications.

Figure 7:
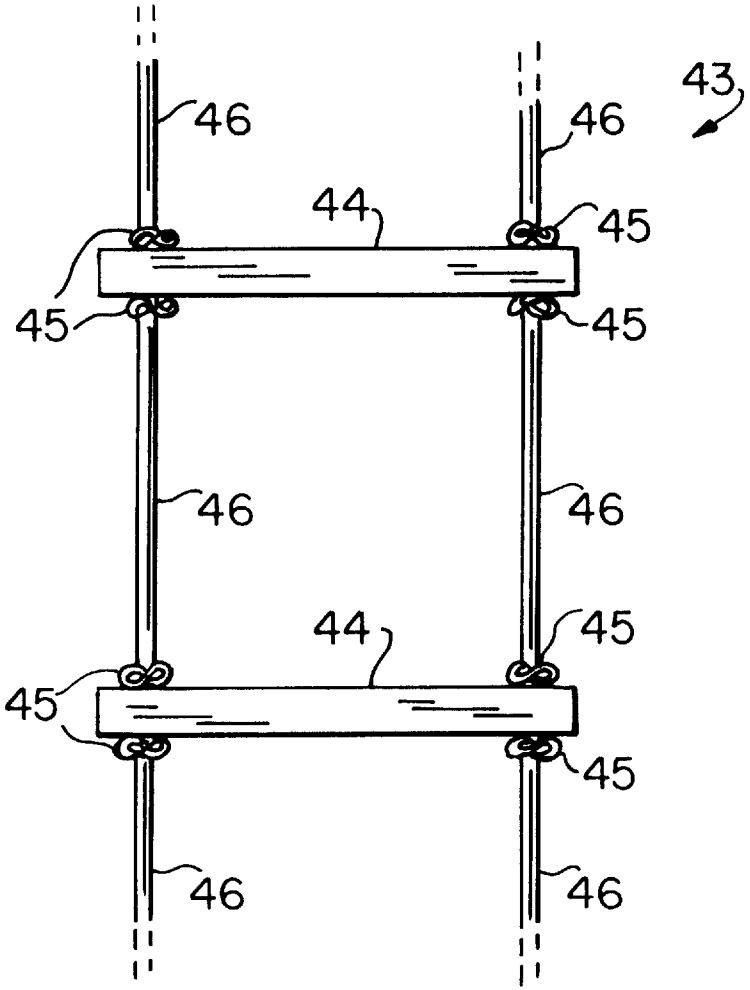
FIG. 7 is a partial pictorial view of one type of ladder used in the present invention.

FIG. 7 illustrates a portion of a ladder 43 used in the present invention. Ladder members 46 are connected via knots 45 to rungs 44, which may be made of any suitable material such as plastic or aluminum with knots 45 spaced to spaced the steps 44 as desired.

Figure 8:
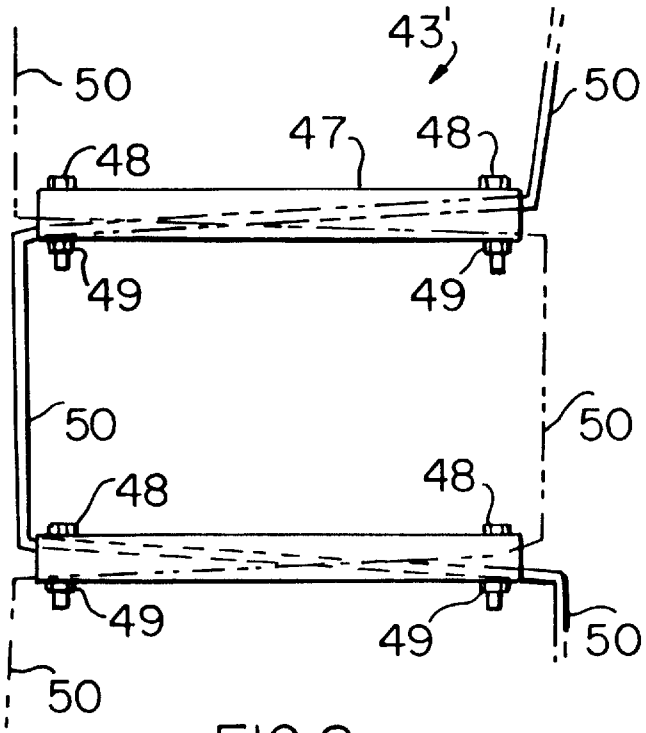
FIG. 8 is a partial pictorial view of one type of ladder used in the present invention.

FIG. 8 illustrates an alternate ladder 43' having square hollow aluminum rungs 47 with chains 50 used as ladder members. Bolts 48 with nuts 49 are used to secure the chains 50 in place. The dotted line and the parallel lines are used to indicate that the chains 50 are passed through hollow aluminum steps 47 to increase the strength of the ladder 43'.

Figure 9:
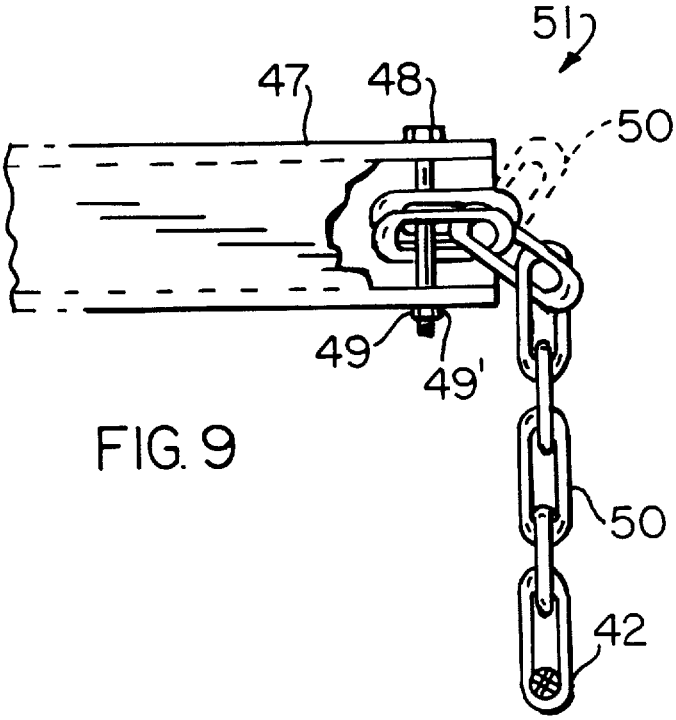
FIG. 9 is an enlarged illustration of the chain connection to a hollow metal rung of a chain ladder.

FIG. 9 illustrates the connection of the preferred embodiment of the ladder 51 having member chains 50 to the rungs 47.

In this embodiment, chains 50 do not pass through the aluminum steps 47. This embodiment also shows the chains 50 to be in sections each attached at the end of each rung 47. It is to be understood that only one link of chain 50 need be attached via bolt 48 if so desired. Nut 49 and lock washer 49' are conventional as understood in the art.

Figure 10:
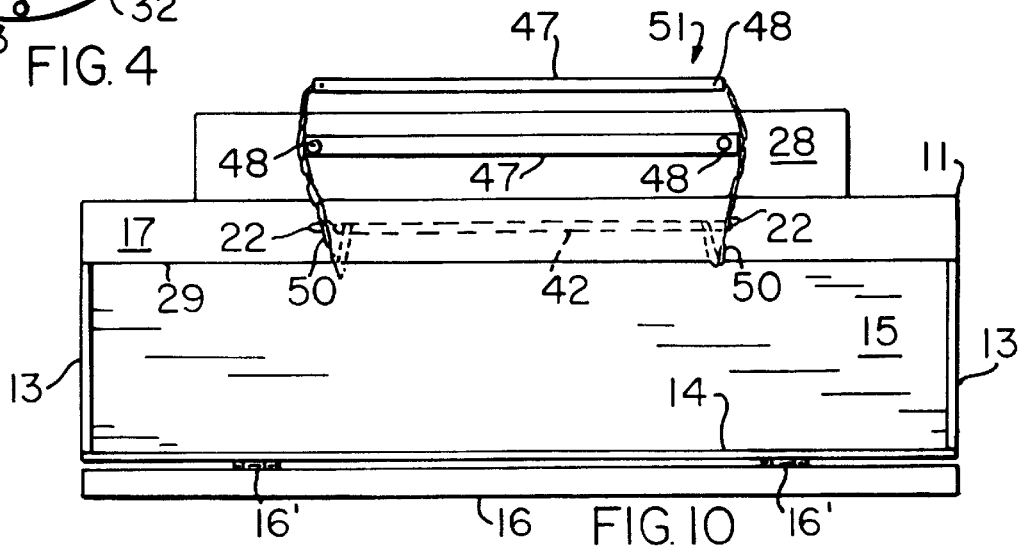
FIG. 10 is a top diagrammatic view of the entire fire escape assembly as it would appear mounted beneath a window and in use.

FIG. 10 illustrates a top view of the escape ladder assembly in accord with the present invention in use from a second or third story window. Lid 16 has been opened and rests forwardly of box front wall 14 on hinges 16'. The ladder 51 has been deployed out a window over sill 28. Chains 50 support rungs 47. Cable 42 is used between cleats 22. Box 11 is approximately 40" in length in order to be wider than a normal house window having a width of less that 37". This width of the box 11 is chosen to prevent movement of the box 11 through the window in the event the total load on the ladder 51 exceeds the anchorage force of the box assembly 10. In addition, box 11 has sufficient capacity to provide storage space for flashlights and other emergency equipment.

As can be seen from the angles of line 30 in FIG. 3, the ledge 17 operates to direct upward force on cleats 22 outwardly away from window sill 28 to force box 11 against wall 26 such that screws 25 not necessary to hold box 11 in position. The anchorage forces also provide for frictional engagement of ladder chains 50 against window sill edges 28' to further absorb the force making it highly unlikely that box 11 will be lifted or rotated during use of the ladder 51.

It is also important to note that the present invention is usable in any emergency, such as a hurricane or earthquake, where damage to the normal exit means, such as internal stairs, has occurred.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A fire escape assembly adapted to be used by a person exiting through a window comprising a collapsible ladder and anchorage means, said ladder being affixed to said anchorage means, said anchorage means including a container sized to accommodate said ladder therein and cleat means affixed to said container, said ladder including a plurality of spaced horizontal rungs and a pair of spaced vertical side members, each said rung having opposite end portions, first securing means for attaching said side members to each said end portion of each said rung, second securing means for affixing each said side member to said cleat means, said container being an elongate box having a planar rear wall to be disposed adjacent a room wall of a building beneath a window sill therein, a pair of planar side walls, a planar front wall, a floor member and a planar ledge member having a front edge and a rearward edge lengthwise thereon, said ledge member being mounted on a top edge of said rear wall to dispose said front edge forwardly of said rear wall, said cleat means being mounted to said rear wall inwardly of said box and rearwardly of said front edge of said ledge member, said front edge of said ledge member being engaged by said vertical side members of said ladder to provide that force applied to said ladder when said ladder is in use is directed substantially rearwardly and horizontally against said front edge to force said rear wall of said container against a room wall to inhibit movement of said container, said box further including an elongate top member, extending from said ledge member to said front wall and between said side walls, hinge means between said top member and said front wall for movably mounting said top member adjacent a top edge of respective said front wall and said side walls.

2. The assembly as defined in claim 1 wherein said ladder is substantially fireproof and includes a plurality of metal rungs and a pair of lengths of metal chain attached to respective ends of said rungs, and metal securing means for attaching said chains to each of said rungs.

3. The assembly of claim 2 wherein each of said rungs has a hollow box cross-section, said metal securing means including an elongate threaded bolt and nut, said rung having vertical openings adjacent each said end protion, said bolt passing through said openings and through a link of said metal chain disposed between said openings, said nut being threaded on said bolt outwardly of said rung to tightly affix said bolt and nut to said rung.

4. The assembly as defined in claim 1 wherein said cleat means includes a pair of spaced cleats.

5. The assembly as defined in claim 1 wherein said ladder includes a pair of rope members affixed to respective ends of said rungs.

6. The assembly as defined in claim 1 wherein said cleat means includes a pair of spaced cleats that are disposed downwardly, said second securing means including a loop member secured around each said cleat.

7. The assembly as defined in claim 6 further including a cross member having loop portions to and between said cleats to support said side members from respective said cleats via said cross member.

8. The assembly as defined in claim 1 wherein said cleat means includes a generally circular ring-shaped cleat body having an interior space, a downwardly disposed cleat integral to said body and extending into said interior space and outwardly of said body, and a plurality of holes formed in said body for attachment thereof to said rear wall.

9. The assembly of claim 1 wherein said cleat means is secured to said rear wall at a lower portion thereof generally adjacent said floor member.

10. The assembly as defined in claim 1 wherein said side members of said ladder are lengths of chain, said second securing means including a length of cable attached to and between said lengths of chain, each said rung having a hollow box cross-section, said first securing means including an elongate threaded bolt and nut, said rungs having vertical openings adjacent each said end portion, said bolt passing through said openings and through a link of said chain disposed therebetween said openings, said nut being threaded on said bolt outwardly of said rung to tightly affix said bolt and nut to said rung.

11. The assembly as defined in claim 1 wherein the width of said container is sized to be wider than the window that is to be exited using said assembly.

12. A fire escape assembly adapted to be used by a person exiting through a window comprising a collapsible ladder and movable anchorage means for storing and supporting said ladder affixed thereto, said movable anchorage means including a container sized to accommodate said ladder therein and cleat means affixed to said container, said movable anchorage means being unsecured to a wall or floor beneath a window to permit ready movement thereof by a person from a window to another window, said ladder including a plurality of spaced horizontal rungs and a pair of spaced vertical side members, each said rung having opposite end portions, first securing means for attaching said side members to each said end portion of each said rung, second securing means for affixing each said side member to said cleat means, said container being an elongate box having a planar rear wall to be disposed adjacent a room wall of a building beneath a window sill therein, a pair of planar side walls, a planar front wall, a floor member and a planar ledge member having a front edge and a rearward edge of said rear wall to dispose said front edge forwardly of said rear wall and slightly forwardly of said cleat means, said cleat means being mounted to said rear wall inwardly of said box and rearwardly of said front edge of said ledge member, said front edge of said ledge member being engaged by said vertical side members of said ladder to provide that force applied to said ladder when said ladder is in use is directed substantially rearwardly and horizontally against said fron edge to force said rear wall of said container against a room wall to inhibit movement of said container said cleat means including an elongate metal plate mounted to and against said rear wall, said plate having a pair of generally oval openings cut out therefrom to define a pair of spaced downwardly disposed T-shaped cleats extending outwardly from said plate.

13. The assembly as defined in claim 12 wherein each said cleat is secured to said rear wall at a lower portion thereof closely adjacent said floor member.

* * * * *